United States Patent [19]

Tsunefuji

[11] 4,179,593

[45] Dec. 18, 1979

[54] CHANGE-OVER SWITCH FOR PRINTED CIRCUIT BOARD

[75] Inventor: Katsuhiko Tsunefuji, Suwa, Japan

[73] Assignee: Olympus Optical Company, Ltd., Tokyo, Japan

[21] Appl. No.: 885,875

[22] Filed: Mar. 13, 1979

[51] Int. Cl.[2] ..... H01H 9/00

[52] U.S. Cl. ..... 200/292; 200/153 LB; 200/250; 200/325

[58] Field of Search ..... 200/153 LB, 153 LE, 200/153 L, 63, 250, 282, 42 T, 291–318, 321, 222, 325, 245, 246, 276, 277

[56] References Cited

U.S. PATENT DOCUMENTS

| | | | |
|---|---|---|---|
| 3,595092 | 7/1971 | Mayer et al. | 200/291 |
| 3,622,934 | 11/1971 | Yano | 338/198 |
| 3,746,803 | 7/1973 | Cryer | 200/246 |
| 3,946,185 | 3/1976 | Gruner | 200/245 |
| 3,965,319 | 6/1976 | Lockard | 200/153 LB |

*Primary Examiner*—Harold J. Tudor

*Attorney, Agent, or Firm*—Ostrolenk, Faber, Gerb & Soffen

[57] ABSTRACT

A change-over switch for a printed circuit board comprises an electrically conductive, resilient wire which is disposed in the manner of a torsion spring, on an electrically conductive support stud which in turn, is secured on an insulating substrate so as to be in electrical contact with a patterned electrical circuit printed thereon. The wire has a pair of limbs which are formed as movable electrical contacts and which are biased by the resilience of the wire material to move in opposite directions along a path on which are disposed a pair of stationary contacts in the form of studs secured to the substrate in electrical contact with other portions of the patterned electrical circuit. An operating member either constrains or permits a movement of the resilient wire under its bias, thus operating the movable contacts into and out of engagement with the stationary contacts.

15 Claims, 9 Drawing Figures

CHANGE-OVER SWITCH FOR PRINTED CIRCUIT BOARD

RELATED APPLICATIONS

This application is a continuation in part of my copending U.S. application Ser. No. 663,229 filed Mar. 3, 1976, now abandoned.

BACKGROUND OF THE INVENTION

The invention relates to change-over switches for printed circuit boards, and more particularly, to change-over switches assembled directly on an insulating substrate having a patterned electrical circuit printed thereon.

In an electrical instrument which incorporates a printed circuit board formed by a substrate of an insulating material such as ceramic and on which a patterned electrical circuit is printed, it is often necessary to position a switch for switching the electrical circuit at a location on or adjacent to the substrate. Since the switch is usually formed as a discrete component, it occupies a large proportion of the space above the substrate when it is disposed thereof, making it difficult to manufacture the instrument as a compact unit. Such a disadvantage can be overcome when the volume occupied by the switch is minimized by directly assembling switch parts such as a movable contact, stationary contacts and an operating member onto the substrate to form an integrated switch.

SUMMARY OF THE INVENTION

It is an object of the invention to provide a change-over switch which is integrally assembled with a printed circuit board by directly assembling switch parts such as movable contact, stationary contacts and operating member onto the substrate of the circuit board.

It is another object of the invention to provide a change-over switch in which the movable contact of the switch is formed by an electrically conductive, resilient wire and each of the fixed contacts has a slanted or tapered surface formed in it so as to achieve a stable electrical contact with the movable contact.

A switch constructed in accordance with this invention is directly assembled on the substrate, and hence occupies a minimized space thereon. A stud which supports a movable contact and other conductive studs which form the stationary contacts are adhesively secured to the patterned electrical circuit formed on the substrate, thus minimizing the number of connections and the chance of failure. The use of a resilient wire, rather than a leaf spring, for the movable contacts reduces the wear of the spring, and facilitates assembly. The stationary contact is formed with a slanted surface for engagement with the movable contact so as to achieve a sliding contact therewith to improve contact reliability.

DETAILED DESCRIPTION OF PREFERRED EMBODIMENTS

Figure 1:
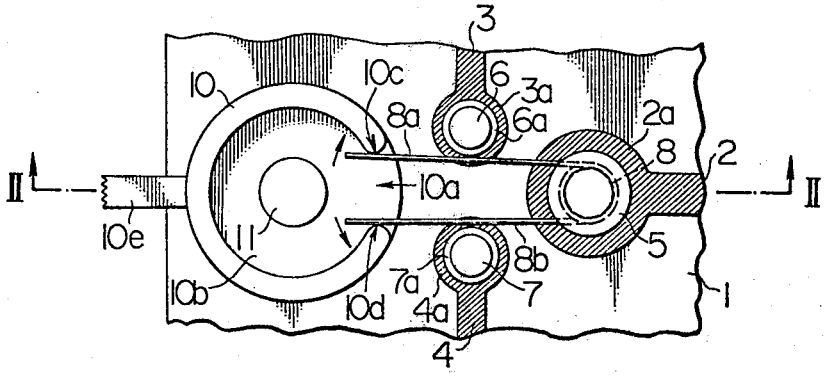
FIG. 1 is a plan view of a change-over switch constructed according to one embodiment of the invention.

Referring to FIG. 1, there is shown a printed circuit board comprising a substrate 1 of an insulating material on which a plurality of patterned electrical circuit elements 2, 3 and 4, shown by hatched lines, are printed. At their one end, each of the patterned circuit elements 2, 3 and 4 is formed with a circular portion **2*a*, 3*a* or 4*a*, respectively, which is centrally formed with an opening 1*a*, 1*b* (see FIG. 2, one of them being not shown) which extends through the patterned circuit elements and substrate 1. Electrically conductive stud 5 for carrying an electrical contact has its lower end 5*a* fitted into opening 1*a*, and is provided with a concentric flange 5*b* bonded to the circular portion 2*a* by adhesive means 9 (see FIG. 2) such as solder, thereby fixedly mounting stud 5 on substrate 1. The circular portions 3*a* and 4*a* are located symmetrically with respect to the circular portion 2*a*, and have conductive studs which form stationary contacts 6 and 7 fixedly mounted in their respective openings (one of them being invisible in FIG. 2). These studs are similarly secured to substrate 1 by fitting their lower ends into associated openings in the substrate and securing their flanges 6*a*, 7*a* to the circular portions 3*a* and 4*a*, respectively, by adhesive means 9 (see FIG. 2). In this manner, support stud 5 is electrically connected with patterned circuit element 2, and the stationary contacts 6 and 7 are electrically connected with the patterned circuits 3 and 4**, respectively.

Switching member 8 formed of an electrically conductive resilient wire is disposed on the support stud 5 in the manner of a torsion spring, and has its limbs formed as movable contacts **8*a*, 8*b* biased to move away from each other by the resilience of the wire material. Thus, one of the limbs, 8*a*, tends to rotate clockwise about the stud 5 while the other limb 8*b* tends to rotate counter-clockwise about the stud 5. Limbs 8*a*, 8*b* extend beyond the stationary contacts 6, 7 and to the left thereof, as viewed in FIGS. 1 and 2, for engagement with an operating member 10 under the condition that they are charged with a turning force. Member 10 is constructed of an electrically insulating material in the form of a bottomed sleeve which is provided with a notch 10*a*, and is rotatably mounted on substrate 1 at a position which is symmetrical to the stud 5 with respect to a line joining the stationary contacts 6, 7. Specifically, member 10 includes a bottom 10*b* which is placed on substrate 1 and which is centrally engaged by stud 11, the latter being provided with a locking ring 12. Notch 10*a* is formed in the sleeve at a position which is directly opposite to the stud 5, and has a width which is less than the clearance between the stationary contacts 6, 7 so that a bearing engagement is normally maintained between the free end of one contact 8***a* and a sidewall 10*c* of the notch and between the free end of the other movable contact 8*b* and another sidewall 10*d* of the notch 10*a*. The operating member 10 is formed with an integral switching piece 10*e* which extends outwardly from the periphery of sleeve, and which can be operated to turn the operating member 10 about the stud 11 for the purpose of operating the switch. However, operating member 10 is normally retained by a click stop or detent mechanism, similar to that shown in FIG. 8, in a position in which neither movable contact 8*a* nor 8*b* engages the stationary contact 6 or 7. In this position, the switch is open or in its off position.

Figure 3:
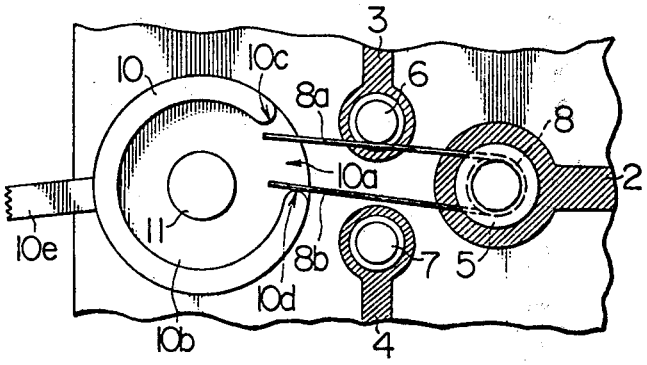
FIG. 3 is a similar view of the switch shown in FIG. 1, illustrating one operating position thereof.

In operation, when it is desired to interconnect the patterned circuit elements 2 and 3, switching piece 10*e* is turned counter-clockwise, as viewed in FIG. 1, with member 10 turning counter-clockwise about the stud 11, whereby movable contact 8*a* which bears against sidewall 10*c* of the member 10 is permitted to move clockwise about support stud 5. It should be understood that this angular movement takes place through a release of the charged resilience. As movable contact 8*a* moves angularly in this manner, it bears resiliently against stationary contact 6 thereby establishing an electrical interconnection between patterned circuit elements 2 and 3 through stud 5, movable contact 8*a* and stationary contact 6, as shown in FIG. 3. At this time, the operating member 10 is further rotated to clear the movable contact 8*a*, and is temporarily retained in such position by a click stop mechanism of the type shown in FIG. 8. When operating member 10 is moved counter-clockwise, its other sidewall 10*d* moves the other movable contact 8*b* further away from the stationary contact 7 against its own resilience, but it should be understood that this tends to increase the contact pressure between the other movable contact 8*a* and stationary contact 6. In this position of the switch, circuit element 2 is connected with the circuit element 3 and is disconnected from the circuit element 4.

When it is desired to interconnect patterned circuit elements 2 and 4, switching piece 10*e* is turned in the opposite direction to turn operating member 10 clockwise. Thereupon the other movable contact 8*b* is brought into contact with stationary contact 7 and movable contact 8*a* is moved away from stationary contact 6, thus establishing an electrical interconnection between circuit elements 2 and 4 and disconnecting circuit element 2 from the circuit element 3.

Figure 2:
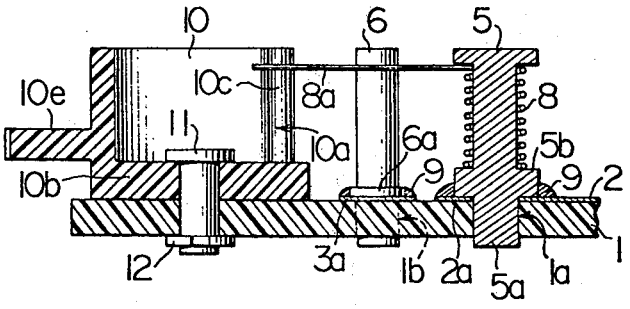
FIG. 2 is a cross section taken along the line II—II of FIG. 1 looking in the direction of arrows II—II.
Figure 4:
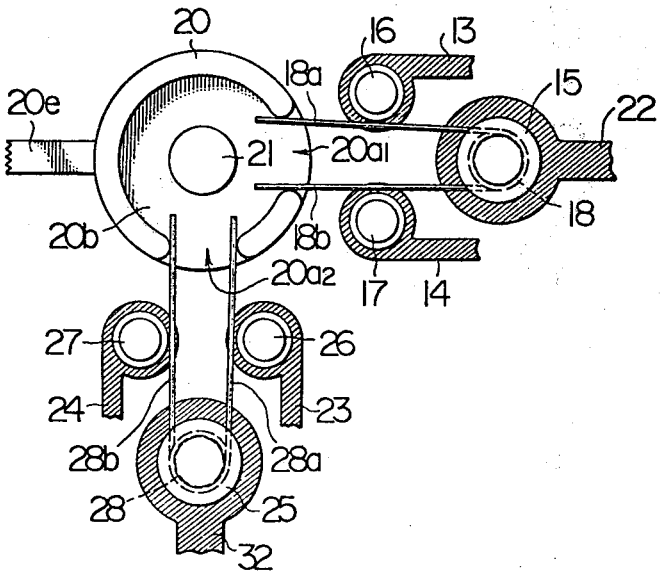
FIG. 4 is a plan view of a change-over switch constructed according to another embodiment of the invention.

Instead of the single pole, double throw switch shown in FIGS. 1, 2 and 3, the single operating member may be utilized to form a double pole double throw switch as shown in FIG. 4. In this construction, a pair of support studs 15, 25 are disposed around a single operating member 20, and a pair of switching member 18, 28 are disposed thereon so that pairs of movable contacts 18*a*, 18*b* and 28*a*, 28*b* engage notches $20a_1$, $20a_2$ formed in operating member 20. The latter has bottom 20*b* as before, and additionally includes switching piece 20*e*, which may be operated to turn member 20 about stud 21 therefor to bring one of the movable contacts, 18*a* or 18*b*, of one switching member 18 into contact with a stationary contact 16 or 17. This connects patterned electrical circuit element 22 with patterned electrical circuit element 13 or 14 and simultaneously bringing one of the movable contacts, 28*a* or 28*b*, of the other switching member 28 into contact with a stationary contact 26 or 27 to thereby connect patterned electrical circuit element 32 with patterned electrical circuit elements 23 or 24.

Figure 5:
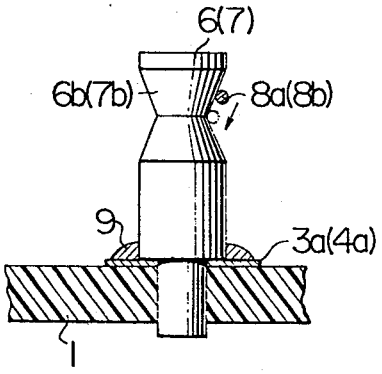
FIG. 5 is a side elevation of another example of a stationary contact.
Figure 6:
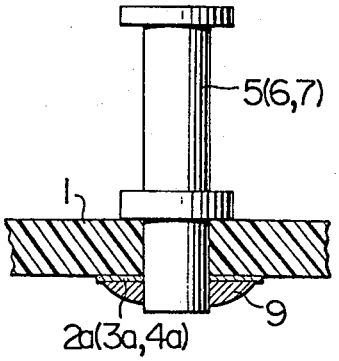
FIG. 6 is a side elevation of another example of means for securing the support stud for the movable contact and the stationary contacts to the substrate.

In each of the embodiments described to this point, stationary contacts have been shown as comprising a rod having a constant diameter. However, as illustrated in FIG. 5, such stationary contacts may be formed with a conically slanted or tapered surface 6*b* (7*b*). When the stationary contact is formed in this manner, the movable contact will engage such stationary contact with a component of force which causes the movable contact to slide along the slanted surface 6*b* (7*b*) toward a portion of the stationary contact having a reduced diameter. Such sliding contact serves to maintain the surface of the stationary contact 6 (7) clean and to increase its area of contact, thus increasing reliability of the switching operation.

In the embodiments described to this point, patterned electrical circuit elements 2, 3 and 4 have been formed on the upper surface of substrate 1. However, patterned electrical circuit elements may be entirely or partially formed on the lower surface of substrate 1. In such case, support stud 5 for the movable contact and the studs which form stationary contacts 6, 7 may have their lower ends extend through openings in substrate 1 to the underside thereof and secured to circular portions 2*a*, 3*a* and 4*a* located thereon as by adhesive 9.

When one of the movable contacts 8*a*, 8*b* of the single pole, double throw switch shown in FIG. 1 is fixedly attached to substrate 1 and the other left movable, there is provided a single pole, single throw switch.

Figure 7:
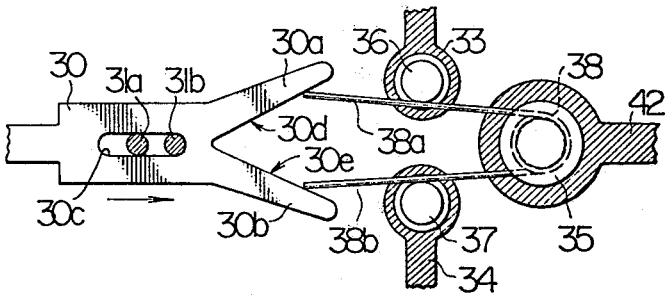
FIG. 7 is a plan view, partially in section, another change-over switch constructed according to a further embodiment of my invention.

Instead of a turning motion as mentioned in connection with the above embodiments, a sliding movement may be utilized for the operating member. Specifically, referring to FIG. 7, operating member 30, constructed of an electrically insulating material, is formed with a pair of forked ends 30*a*, 30*b*, having respective inner surfaces 30*d*, 30*e* which forms an angle with the longitudinal centerline of member 30. A pair of patterned electrical circuit elements 33, 34 are formed on the insulating substrate and are associated with respective stationary contacts 36, 37, which are formed in a manner similar to that previously described. Support stud 35 is fixedly mounted on the substrate in electrical connection with patterned electrical circuit element 42 formed thereon. Switching member 38 is disposed on stud 35 and has a pair of limbs which form movable contacts 38*a*, 38*b*. Normally, movable contacts 38*a*, 38*b* are maintained in contact with stationary contacts 36, 37 under the resilience of the material from which the switching member 38 is formed. Operating member 30 is formed with longitudinally extending slot 30*c*, into which extend a pair of stationary pins 31*a*, 31*b*, thus enabling member 30 to slide in the direction indicated by the arrow. The free end of movable contacts 38*a*, 38*b* normally engage the respective inner surfaces 30*d*, 30*e* at the forked end of operating member 30. When operating member 30 is moved in the opposite direction from that indicated by the arrow in FIG. 7, the respective movable contacts 38*a*, 38*b* are allowed to move under the urging of self-biasing forces into engagement with the respective stationary contacts 36, 37. However, when member 30 is moved in the direction of the arrow, inner surfaces 30*d*, 30*e* cause movable contacts 38*a*, 38*b* to move toward each other, thus moving them away from the respective stationary contacts 36, 37 to open an electrical connection therebetween.

Figure 8:
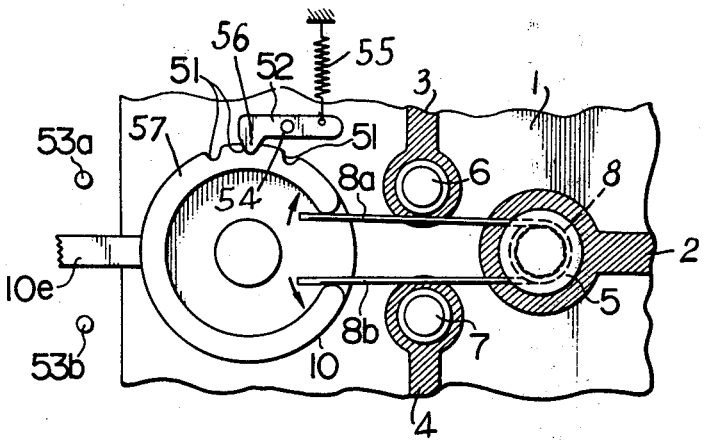
FIG. 8 is a plan view of the embodiment of FIG. 1 with a handle detent means added thereto.

FIG. 8 illustrates the switch embodiment of FIGS. 1 through 3 with a detent mechanism added thereto. Such detent mechanism includes lever 52 mounted on pivot 54 and biased counter-clockwise with respect to FIG. 8 by tension spring 55 to urge lever nose or tip 56 toward the outer surface of operating member sleeve 57. Engagement of nose 56 with any of the three notches 51 in sleeve 57 establishes an operative position for switch member 10.

That is, with nose 56 in the middle notch 51, as shown in FIG. 8, neither of the movable contacts 8*a*, 8*b* engages either of the stationary contacts 6, 7. When member 10 is pivoted counter-clockewise to position nose 56 in the right-most notch 51 movable contact 8*a* engages stationary contact 6. Conversely, when member 10 is pivoted clockwise to position nose 56 in the left-most notch 51 movable contact 8*b* engages stationary contact 7. Stops 53*a*, 53*b* are engageable by switching piece or handle 10*e* to limit pivotal motion of member 10.

Figure 9:
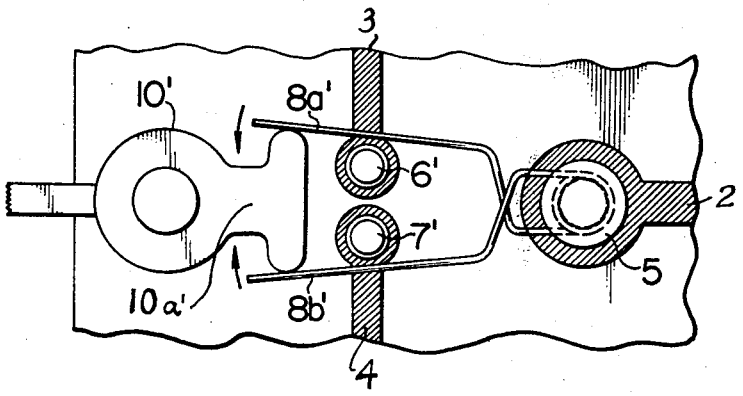
FIG. 9 is a plan view of still another embodiment of a change-over switch constructed in accordance with the instant invention.

In the embodiments herein before described the arms 8*a*, 8*b* of switching member 8 are biased in opposite directions away from each other and are disposed between stationary contacts 6, 7. By contrast, the embodiment of FIG. 9 includes a torsion spring wire whose arms 8*a*', 8*b*' are also biased in opposite directions, but toward one another and are disposed outboard of spaced stationary contacts 6', 7'. The enlarged tip at the free end of radial extension 10*a*' for operating member 10' is disposed between arms 8*a*', 8*b*' and is proportioned so that in the mid-position shown in FIG. 9 neither stationary contact 6', 7' is engaged by either arm 8*a*', 8*b*'. However, when operating member 10' is pivoted counter-clockwise from the mid-position arm 8*b*' engages stationary contact 7' thereby connecting circuit elements 2 and 4. Similarly, when operating member 10' is pivoted clockwise arm 8*a*' engages contact 6' to connect circuit elements 2 and 3.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A change-over switch for a printed circuit board comprising: a substrate of an insulating material on which a plurality of patterned electrical circuit elements are formed; a first electrically conductive support stud fixedly mounted on the substrate in electrical contact with a first of said circuit elements and having a portion extending in front of a first surface of the substrate; a switching member formed of an electrically conductive, resilient wire and comprising a torsion spring having at least one turn wound on said portion of the support stud; said resilient wire having a first extension therefrom which is formed from said torsion spring and which is formed as a first movable contact; said resilient wire having a second extension therefrom which is formed from said torsion spring and which is formed as a second movable contact; said first and second extensions of said torsion spring extending generally in the same direction and being biased by said torsion spring to move in opposite directions; a second electrically conductive stud fixedly mounted on the substrate in electrical contact with a second of said patterned circuit elements and having a first section extending in front of said first surface, said first section of said second conductive stud being formed as a first stationary contact and disposed intermediate the length of said first extension; said first extension of the switching member being normally resiliently biased by said torsion spring and said first stationary contact being located in the path of movement of said first extension under its bias; a third electrically conductive stud fixed to said substrate and in electrical contact with a third of said patterned circuit elements and having a second section extending in front of said first surface; said second section of said third conductive stud being formed as a second stationary contact and disposed intermediate the length of said second extension; said second extension of the switching member being normally resiliently biased by said torsion spring and said second stationary contact being located in the path of movement of said second extension under its bias; said first and second extensions being normally biased toward engagement with said second and third studs, respectively, and an operating member for engaging the end portion of each said extension at the end thereof away from said first stud and past its respective said stationary contact for constraining or permitting movement of each said extension under its said normal bias to selectively connect or disconnect each said extension with the respective said stationary contact; said extensions and said stationary contacts being so placed that as said operating member moves one said extension to constrain it and thereby disconnect that said extension from its said stationary contact, said operating member, combined with said torsion spring, urges and permits the other said extension to connect that other said extension with its said stationary contact; said operating member comprising a body of electrically insulating material which is movable generally parallel to and with respect to the first surface of the substrate for engaging said extensions; said operating member being provided with a switching piece to which force is applied for moving said body.

2. A change-over switch according to claim 1 in which the switching member is positioned completely forward of the first surface.

3. A change-over switch according to claim 1 in which movement of said first extension of said torsion spring is in a plane which is generally parallel to the first surface of the substrate.

4. A change-over switch according to claim 1 in which said operating member includes opposed side walls between which the end portions of both said first and second extensions are disposed for all operating positions of said body; each said side wall being for engaging a respective said end portion.

5. A change-over switch according to claim 4 in which the body of the operating member is rotatably mounted on an axis transverse to the first surface of the substrate whereby said operating member rotates to move.

6. A change-over switch according to claim 4 in which the extensions extend between said second and third conductive studs and are biased away from each other.

7. A change-over switch according to claim 5 in which said operating member defines a projection extending between said extensions and engaged thereby as said operating member moves; said extensions being biased toward each other by said torsion spring.

8. A change-over switch according to claim 7 in which neither of said extensions engage either of said second and third conductive studs when said operating member is in a normal centered position; with said operating member in said normal position said switching member exerting a biasing force to maintain said operating member in said normal position.

9. A change-over switch according to claim 1 also including detent means for holding said operating member in selected predetermined positions; said first extension engaging said second stud when said operating member is in a first of said positions; said second extension engaging said second stud when said operating member is in a second of said positions.

10. A change-over switch according to claim 1 in which the body of the operating member is rotatably mounted on an axis transverse to the first surface of the substrate; said support stud and said axis for said body being operatively positioned so that a straight line drawn therebetween is approximately centered between said second and third studs.

11. A change-over switch according to claim 1 in which the body of the operating member is rotatably mounted on an axis transverse to the first surface of the substrate for movement between radially spaced first and second positions; with said operating member in said first position said first extension engaging said second stud, and said operating member engaging said second extension to move same away from said third stud in a direction winding said turn more tightly to increase contact force between said first extension and said second stud; with said operating member in said second position said second extension engaging said third stud, and said operating member engaging said first extension to move same away from said second stud in a direction winding said turn more tightly to increase contact force between said second extension and said third stud.

12. A change-over switch according to claim 1 in which the body of the operating member is rotatably mounted on an axis transverse to the first surface of the substrate whereby said operating member rotates to move.

13. A change-over switch according to claim 1 in which the extensions extend between said second and third conductive studs and are biased away from each other.

14. A change-over switch according to claim 1 in which said operating member defines a projection extending between said extensions and engaged thereby as said operating member moves; said extensions being biased toward each other by said torsion spring.

15. A change-over switch according to claim 1 in which neither of said extensions engages either of said second and third conductive studs when said operating member is in a normal centered position; with said operating member in said normal position said switching member exerting a biasing force to maintain said operating member in said normal position.

* * * * *